United States Patent [19]

Karino et al.

[11] 4,446,080

[45] May 1, 1984

[54] CARBURETOR WITH STARTING SYSTEM

[75] Inventors: Kimiji Karino; Tokuo Kosuge; Masahiro Souma, all of Katsuta, Japan

[73] Assignees: Hitachi, Ltd.; Hitachi Automotive Engineering Co., Ltd., both of Tokyo, Japan

[21] Appl. No.: 348,017

[22] Filed: Feb. 11, 1982

[30] Foreign Application Priority Data

Feb. 16, 1981 [JP] Japan ..... 56-20042

[51] Int. Cl.[3] ..... F02M 5/02

[52] U.S. Cl. ..... 261/39 D; 261/50 R; 261/DIG. 74; 261/65; 261/DIG. 50; 261/72 R

[58] Field of Search ..... 261/DIG. 50, 39 D, 65, 261/72 R, 50 R, DIG. 74; 123/52 M; 180/297

[56] References Cited

U.S. PATENT DOCUMENTS

| | | | |
|---|---|---|---|
| 2,718,387 | 9/1965 | Carlson et al. | 261/DIG. 50 |
| 2,737,375 | 3/1956 | Kittler | 261/65 |
| 2,824,727 | 2/1958 | Brunner et al. | 261/65 |
| 3,780,718 | 12/1973 | Nambu et al. | 261/39 D |
| 4,191,716 | 3/1980 | Yamashita et al. | 261/39 D |
| 4,253,432 | 3/1981 | Nohira et al. | 123/52 M |
| 4,364,354 | 12/1982 | Kosuge et al. | 261/39 D |

FOREIGN PATENT DOCUMENTS

| | | | |
|---|---|---|---|
| 698056 | 11/1964 | Canada | 180/297 |
| 55-109749 | 8/1980 | Japan | 261/DIG. 50 |
| 732064 | 6/1955 | United Kingdom | 261/DIG. 50 |

*Primary Examiner*—Tim R. Miles

*Attorney, Agent, or Firm*—Antonelli, Terry & Wands

[57] ABSTRACT

A carburetor including a main fuel system and a low-speed fuel system having a throttle valve shaft located parallel to a row of cylinders located in side-by-side relationship substantially perpendicular to the direction of movement of a vehicle. The carburetor is connected to a suction manifold in such a manner that a float chamber is interposed between the throttle valve shaft and the row of cylinders.

6 Claims, 6 Drawing Figures

CARBURETOR WITH STARTING SYSTEM

BACKGROUND OF THE INVENTION

This invention relates to carburetors for internal combustion engines, and, more particularly, to a carburetor provided with a starting system for starting an internal combustion engine.

Generally a starting system of a carburetor includes a starting nozzle exclusively for use for starting the engine, with the nozzle opening downstream of a throttle valve mounted in a suction conduit of the carburetor, to start the engine by supplying fuel through the starting nozzle only when the engine is started.

The internal combustion engine mounting the carburetor provided with such starting system has been faced with the problem that when the throttle valve is opened at engine startup and immediately after startup for acceleration, smooth operation of the engine is unobtainable because the starting fuel supplied through the starting nozzle is small in volume due to the suction negative pressure being near atmospheric pressure.

SUMMARY OF THE INVENTION

This invention has as its object the provision for a carburetor of an internal combustion engine provided with a starting system of low fuel consumption which is capable of effecting engine acceleration smoothly at engine startup and immediately after startup.

Experiments on carburetors have been conducted and it has been ascertained that it is possible to obtain smooth engine operation if vaporization of starting fuel is achieved in good condition even when the starting fuel is small in volume.

An outstanding characteristic of the invention is that, in a multiple cylinder internal combustion engine, a carburetor is mounted in such a manner that a throttle valve shaft of the carburetor is disposed parallel to a row of cylinders located in side-by-side relation perpendicular to the direction of movement of an automotive vehicle mounting the internal combustion engine, and that a float chamber of the carburetor is interposed between the throttle valve shaft and the cylinders when the carburetor is connected to a suction manifold.

Another outstanding characteristic of the invention is that the carburetor includes a starting nozzle opening downstream of a throttle valve on the float chamber side, and that the throttle valve shaft is located in a position spaced apart from the axial center line of a suction conduit of the carburetor in a direction opposite the direction in which the float chamber is located and supported for rotation in such a manner that the float chamber side of a throttle valve secured to the throttle valve shaft moves toward the main fuel nozzle side of the carburetor.

DESCRIPTION OF THE PREFERRED EMBODIMENT

A preferred embodiment of the invention will now be described by referring to the accompanying drawings.

Figure 1:
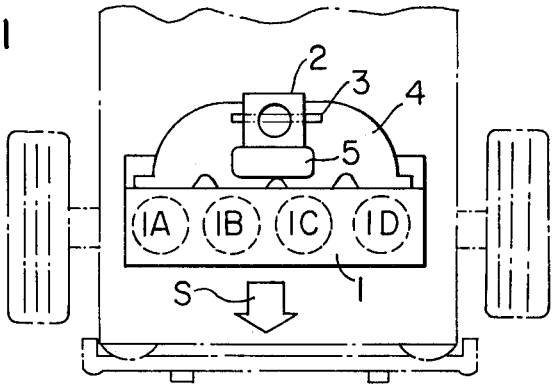
FIG. 1 is a schematic view of the carburetor provided with the starting system according to the invention, shown as being mounted on an internal combustion engine.

FIG. 1 shows the relative positions of an internal combustion engine and a carburetor. Cylinders 1A, 1B, 1C and 1D of a multiple cylinder internal combustion engine 1 are arranged in a row perpendicular to the direction of movement S of an automotive vehicle, and a carburetor 2 is connected to a suction manifold 4 in such a manner that a throttle valve shaft 3 is located parallel to the row of cylinders 1A–1D. A float chamber 5 is interposed between the row of cylinders 1A–1D and the throttle valve shaft 3.

Figure 2:
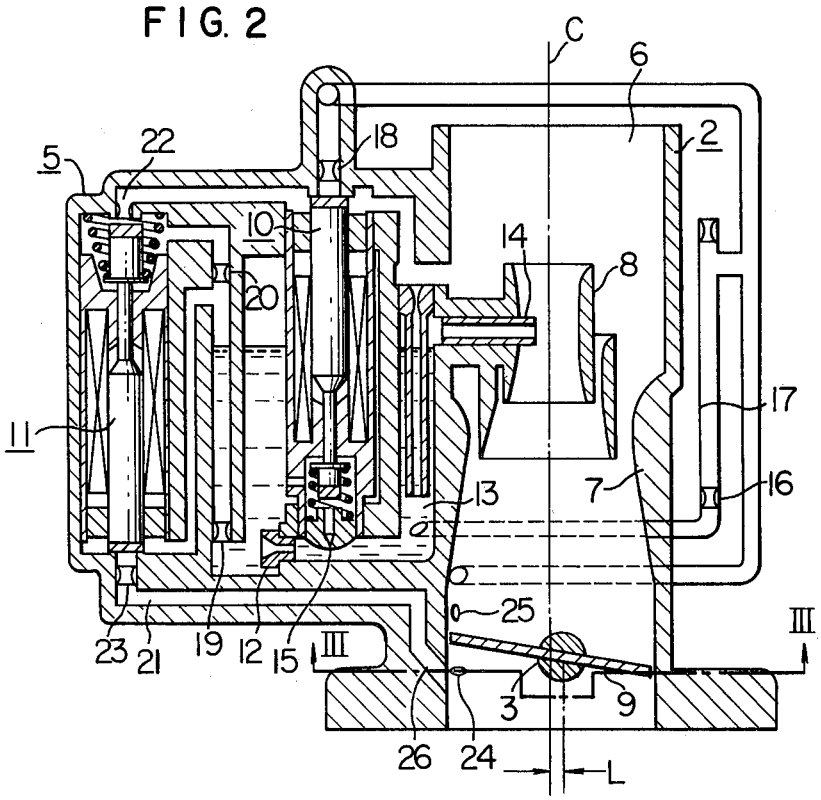
FIG. 2 is a vertical sectional view of the carburetor provided with the starting system according to the invention.

FIG. 2 shows the construction of the carburetor 2 including a suction conduit 6 formed with a major venturi 7 and a minor venturi 8, and a throttle valve 9 supported on the throttle valve shaft 3 located downstream of the venturis 7 and 8. In FIG. 2, the float chamber 5 is located on the left side of the suction conduit 6 and, as shown in FIG. 1, interposed between the throttle valve shaft 3 and the row of cylinders 1A–1D. The throttle valve shaft 3 is disposed in a position spaced apart by a distance L from the axial center line C of the suction conduit 6 in a direction opposite the direction in which the float chamber 5 is located. Thus, the air flowing through the throttle valve 9 in the suction conduit 6 on the side thereof nearer to the float chamber 5 from the center line C is larger in volume than the air flowing through the throttle valve 9 on the side thereof opposite the float chamber 5 with respect to the center line C. In the embodiment shown and described hereinabove, the distance L is set at about 1 mm.

The float chamber 5 has mounted therein a float, not shown, a fuel-air mixture control valve 10 for controlling the mixture flowing through a main fuel system and a low-speed fuel system, and a starting fuel control valve 11 for controlling the mixture flowing through a starting system. The main fuel system includes fuel supplied through a main jet 12, a main fuel passageway 13 and a main nozzle 14, to which is added fuel supplied through an auxiliary main fuel jet 15. The low-speed fuel system includes fuel supplied through a low-speed jet 16, and a low-speed fuel passageway 17, to which is added air supplied through an auxiliary low-speed air bleed 18. The main and low-speed fuel-air mixture control valve 10 is electrically actuated so as to control the opening of the auxiliary main fuel jet 15 and low-speed auxiliary air bleed 18 by the duration of a signal pulse, to effect adjustments of the air-fuel ratio of the fuel-air mixtures flowing through the main and low-speed fuel systems. The main and low-speed fuel-air mixture control valve 10 is operative to keep the air-fuel ratio of the fuel-air mixture at about 14.7 during normal engine operation in accordance with signals supplied from an $O_2$ sensor mounted in an exhaust system and an air-flow meter for sensing suction air.

Meanwhile the starting system has fuel supplied through a starting fuel jet 19, a starting air bleed 20 and a starting fuel passageway 21. The starting fuel-air mixture control valve 11 is electrically actuated to control the opening of a richer air bleed 22 and a richer jet 23 by the duration of a signal pulse, to effect adjustments of the air-fuel ratio of the fuel-air mixtures flowing through the starting fuel system. The starting fuel-air mixture control valve 11 is operative to gradually render the mixture leaner as engine warmup progresses and has its signal supplied as from a temperature sensor sensing the temperature of the cooling water.

The control valves 10 and 11 receive control signals from a control, not shown, which may, for example be a micro-computer.

Figure 3:
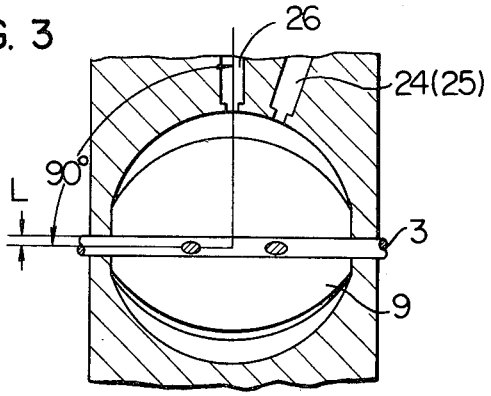
FIG. 3 is a sectional view taken along the line III—III in FIG. 2.

The most important feature of the invention is that in the carburetor located in the position shown in FIG. 1 in the specific structural relationship with the engine cylinders, an idle port 24 of the low-speed fuel system opens downstream of the throttle valve 9 on the float chamber 5 side with respect to the center line C, a bypass port 25 of the low-speed fuel system opens in the vicinity of the throttle valve 9 on the float chamber 5 side with respect to the center line C, and a starting nozzle 26 of the starting fuel system opens downstream of the throttle valve 9 on the float chamber 5 side with respect to the center line C. FIGS. 2 and 3 show the positions in which the ports 24, 25 and nozzle 26 are preferably located. That is, the starting nozzle 26 opens on the wall surface of the suction conduit 6 at a right angle to the throttle valve shaft 3 and on the float chamber 5 side of the throttle valve 9. The idle port 24 opens on the wall surface of the suction conduit 6 close to the starting nozzle 26 and on the float chamber 5 side of the throttle valve 9. The bypass port 26 opens immediately above the idle port 24 and upstream of the throttle valve 9.

Operation of the carburetor of the aforesaid construction and the effects achieved thereby will now be described.

At engine startup and warmup, the throttle valve 9 is opened and moved to a first idling position (in which the opening is slightly larger than in an idling position) to supply fuel from the main nozzle 14, idle port 24 and bypass port 25 through the main and low-speed fuel passageways 13 and 17. The fuel supplied from the main nozzle 14, idle port 24 and bypass port 25 has its volume controlled to a predetermined level by the main and low-speed fuel-air mixture control valve 10. Generally the fuel-air mixture has an air-fuel ratio of below 14.7 (the mixture is richer).

At the same time, starting fuel is being supplied from the starting nozzle 26 through the starting fuel passageway 21 and has its volume being controlled by the starting fuel-air mixture control valve 11 to a level suitable for starting the engine. At this time, the starting nozzle 26, which plays an important role in engine startup and warmup, opens downstream of the throttle valve 9 on the float chamber 5 side thereof in the manner shown in FIG. 3. This enables atomization of the fuel to be effected satisfactorily, for the reason presently to be described.

More specifically, the throttle valve shaft 3 is located in a position biased from the axial center line C of the suction conduit in a direction opposite the direction in which the float chamber 5 is located. By this arrangement, the volume of air flowing through the throttle valve 9 on the float chamber 5 side thereof becomes greater than that of the air flowing through the opposite side of the throttle valve 9, to enable the fuel from the starting nozzle 26 to be better atomized by a degree corresponding to the excess air flow. It will be appreciated that the more satisfactorily fuel atomization is achieved, the more stable the engine operation becomes.

The fuel supplied from the idle port 24 and bypass port 25 is satisfactorily atomized for the same reason, thereby contributing to stable operation of the engine.

Assume that the operator accelerates by opening the throttle valve 9 from the engine startup and warmup condition.

As the throttle valve 9 is opened and the vehicle moves in the direction indicated by S, the liquid level in the float chamber 5 becomes higher on the right side thereof as shown in FIG. 2 because of the structural relationship shown in FIG. 1. Thus, the fuel supplied through the main and low-speed fuel systems is increased by a volume corresponding to this rise in liquid level, to thereby enable acceleration to be achieved.

In a starting nozzle of the prior art, there has been a tendency that atomization of the fuel supplied therethrough is unable to be achieved satisfactorily, because the suction negative pressure applied to the starting nozzle 26 reaches near the atmospheric pressure by a degree corresponding to an increase in the opening of the throttle valve 9 as the latter is opened. In the embodiment of the invention shown and described herein, this disadvantage of the prior art is eliminated, and atomization of the fuel can be achieved satisfactorily, by virtue of the arrangement that the throttle valve shaft 3 is biased in a direction opposite the float chamber 5 with respect to the axial center line C of the suction conduit 6 to thereby increase the volume of air flowing through the float chamber 5 side of the throttle valve 9.

The above-mentioned experiments will now be described. The carburetor according to the invention was compared with a carburetor of the prior art. The arrangements of the starting nozzles and the experimental conditions are as follows.

(1) Starting Nozzles

In the prior art, the throttle valve shaft is located on the axial center line of the suction conduit and the starting nozzle opens downstream of the throttle valve in a position in which it crosses the throttle valve at a right angle.

In the present invention, the throttle valve shaft 3 is biased from the axial center line C of the suction conduit 6 and the starting nozzle 26 opens downstream of the throttle valve 9 on the side thereof on which the air flow rate is higher and in a position in which it crosses the throttle valve 9 at a right angle.

(2) Experimental Conditions

Air-Fuel Ratio . . . The fuel-air mixture had its air-fuel ratio kept constant (or the fuel volume was kept constant) until it reaches the starting nozzle.

Suction Negative Pressure . . . The suction negative pressure was varied from its level obtained at full open throttle to its level obtained at idle (or from −50 mmHg to −250 mmHg).

Figure 4:
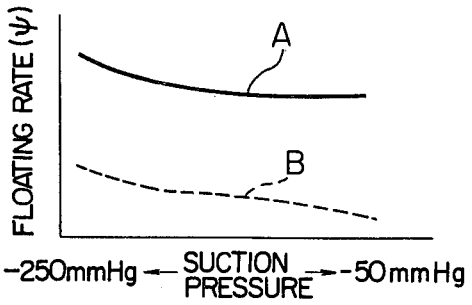
FIG. 4 is a diagrammatic representation of the fuel floating rate in relation to the suction negative pressure of the starting nozzle according to the invention, as compared with a starting nozzle of the prior art.

The results of the experiments conducted under the aforesaid conditions are shown in FIG. 4, in which a solid line A represents the invention and a broken line B indicates the prior art.

In FIG. 4, the floating rate $$\phi = \frac{\text{Supplied Fuel Transferred by Drawn Air While Floating}}{\text{Total Supplied Fuel}} \times 100$$

is an index showing the degree to which the fuel supplied to the starting nozzle was atomized. It will be seen that the higher the value of this rate, the more satisfactorily is atomization of the fuel achieved.

As can be seen in FIG. 4, in the starting nozzle of the prior art, the nearer the suction negative pressure reaches vacuum, the higher is the floating rate $\phi$, and the nearer the suction negative pressure reaches atmospheric pressure, the lower is the floating rate $\phi$. In addition, the floating rate is relatively low.

Meanwhile, in the starting nozzle according to the invention, the floating rate $\phi$ becomes higher as the suction negative pressure reaches nearer vacuum, but shows little change even if the suction negative pressure reaches nearer atmospheric pressure. Besides, the floating rate $\phi$ has a relatively high value.

From the foregoing, it will be understood that atomization of fuel can be achieved more satisfactorily with the starting nozzle 26 according to the invention than with the starting nozzle of the prior art.

The relationship between the temperature and the starting time and between air-fuel ratio and the starting time established in an internal combustion engine having the carburetor 2 shown in FIG. 2 mounted in the same structural relationship as shown in FIG. 1 and in an internal combustion engine having the carburetor provided with the starting nozzle of the prior art mounted in the same structural relation as shown in FIG. 1, respectively, will now be described.

Figure 5:
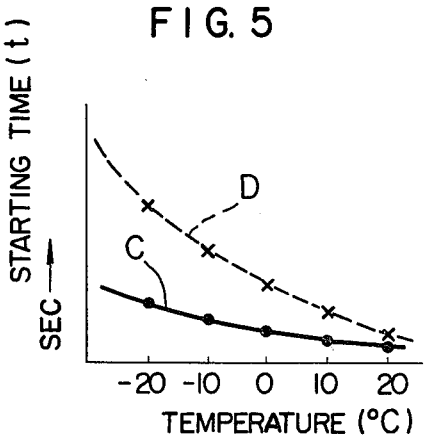
FIG. 5 is a diagrammatic representation of the relationship between the temperature and starting time, obtained with the carburetor provided with the starting system according to the invention and the carburetor provided with a starting system of the prior art when mounted on an internal combustion engine.

FIG. 5 shows the results obtained when the internal combustion engine was started while the air-fuel ratio was kept constant at startup. A solid line C represents the carburetor shown in FIG. 2, and a broken line D indicates the starting nozzle of the prior art. As can be seen in FIG. 5, the carburetor shown in FIG. 2 has a shorter starting time with fully atomized fuel than the carburetor provided with the starting nozzle of the prior art, under all the temperature conditions.

Figure 6:
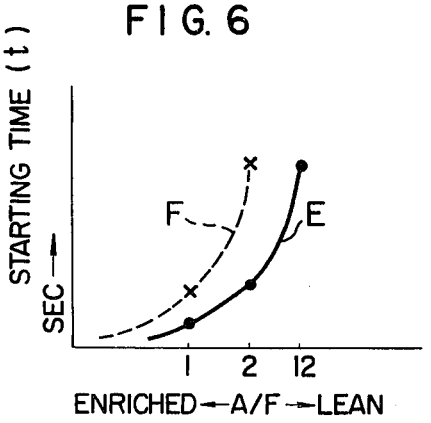
FIG. 6 is a diagrammatic representation of the relationship between the air-fuel ratio and starting time, obtained with the carburetor provided with the starting system according to the invention and the carburetor provided with a starting system of the prior art when mounted in an internal combustion engine.

FIG. 6 shows the results obtained when the internal combustion engine was started while the temperature was kept constant.

A solid line E represents the carburetor shown in FIG. 2, and a broken line F indicates the carburetor provided with the starting nozzle of the prior art. As can be seen in FIG. 6, with the starting time being equal, the carburetor shown in FIG. 2 can tolerate a leaner mixture and the combustible air-fuel ratio is stretched in a leaner mixture direction at startup when this carburetor is used, due to the fact that the fuel is thoroughly atomized.

From the foregoing description, it will be appreciated that in the carburetor of an internal combustion engine provided with the starting system according to the invention, atomization of the fuel supplied to the carburetor during acceleration following engine startup and, warmup can be promoted and consequently, engine operation can be stabilized without increasing fuel consumption.

What is claimed is:

1. A carburetor for an engine, the carburetor comprising a main fuel system and a low-speed fuel system, characterized in that a throttle valve shaft is located in parallel to a row of cylinders of the engine disposed in side-by-side relationship substantially perpendicular to a direction of movement of a vehicle in which the engine is mounted, the carburetor is adapted to be connected to a suction manifold of the engine in such a manner that a float chamber of the carburetor is interposed between the throttle valve shaft and the row of cylinders, said throttle valve shaft is located in a position spaced apart from the axial center line of a suction conduit of said carburetor in a direction opposite to a direction in which the float chamber is located, a starting nozzle of a starting fuel system for supplying starting fuel to a suction conduit at an engine start-up opens downstream of a throttle valve on a side of the float chamber at which an air flow through the suction conduit is the highest, and in that said starting system comprises an idle port constituting the low-speed fuel system opening in said suction conduit adjacent said starting nozzle, and a bypass port constituting said low speed fuel system opening immediately above said idle port and upstream of said throttle valve.

2. A carburetor as claimed in claim 1, characterized in that said throttle valve shaft is supported in the suction conduit in such a manner that a float chamber side of a throttle valve secured to the throttle valve shaft rotates in a direction toward a venturi formed in said suction conduit.

3. A carburetor as claimed in claim 1, characterized by comprising a starting system wherein said starting nozzle opens in said suction conduit in such a manner that an extension of the starting nozzle crosses said throttle valve shaft substantially at a right angle.

4. A carburetor as claimed in claim 1, characterized in that the starting system includes an electrically actuated second fuel-air mixture control valve.

5. A carburetor as claimed in claim 1, characterized in that the starting system comprises an electrically actuated first fuel-air mixture control valve in said main fuel system and said low-speed fuel system, and an electrically actuated second fuel-air mixture control valve in a starting fuel system.

6. A carburetor as claimed in claim 5, characterized in that:

said first fuel-air mixture control valve is controlled in accordance with at least an output signal of an $O_2$ sensor mounted in an exhaust system; and said second fuel-air mixture control valve is controlled in accordance with at least an output signal of a water temperature sensor for sensing the temperature of cooling water.

* * * * *